US005148854A

United States Patent [19]

Nakamoto

[11] Patent Number: 5,148,854

[45] Date of Patent: Sep. 22, 1992

[54] COUNTING DIE CAST MANUFACTURED GOODS

[75] Inventor: Toshinori Nakamoto, Kanagawa, Japan

[73] Assignee: Toshiba Kikai Kabushiki Kaisha, Tokyo, Japan

[21] Appl. No.: 625,821

[22] Filed: Dec. 11, 1990

[51] Int. Cl.[5] ..... B22D 17/00

[52] U.S. Cl. ..... 164/457; 164/150

[58] Field of Search ..... 164/4.1, 457, 150; 264/40.1; 425/169, 170

[56] References Cited

U.S. PATENT DOCUMENTS 4,335,778 6/1982 Motomura et al. ..... 164/150
4,469,164 9/1984 Ishikawa et al. ..... 164/457
4,488,589 12/1984 Moore et al. ..... 164/457 X
4,610,831 9/1986 Mihara ..... 164/457 X
4,881,186 11/1989 Tsuboi et al. ..... 164/457 X
5,062,784 11/1991 Inaba et al. ..... 425/170 X

FOREIGN PATENT DOCUMENTS 57-63233 4/1982 Japan ..... 264/40.1

*Primary Examiner*—J. Reed Batten, Jr.
*Attorney, Agent, or Firm*—Cushman, Darby & Cushman

[57] ABSTRACT

A setting unit sets data indicative of a normal shot operation of the die casting machine and a detection unit detects the operational status of the machine. A distinction unit distinguishes the coincidence of both the setting data and detected data. If the detected data are substantially equal to the setting data then the distinction unit sends a coincidence signal. A counting unit counts the coincidence signals of an injection process.

17 Claims, 6 Drawing Sheets

FIG.5(a) LADLING
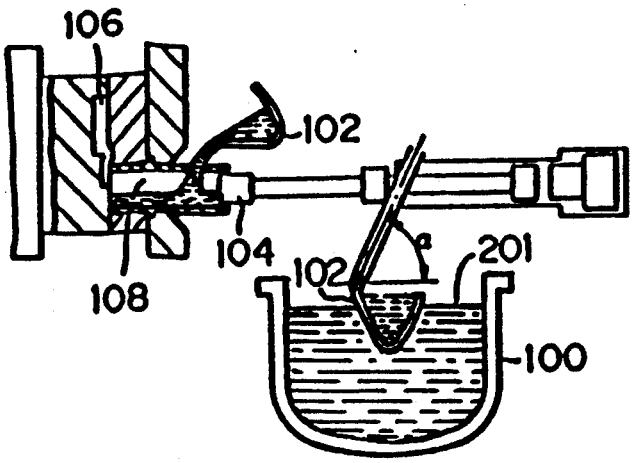
FIG.5(b) LOW SPEED INJECTION
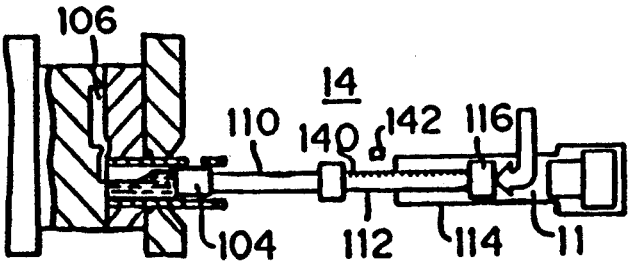
FIG.5(c) HIGH SPEED INJECTION
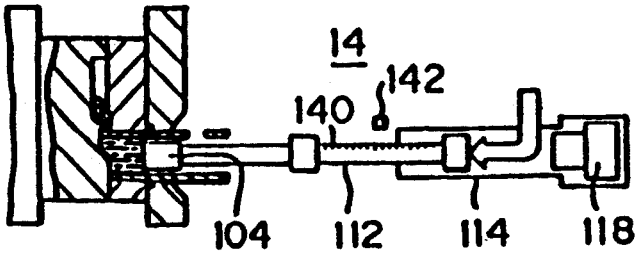
FIG.5(d) INTENSIFICATION (HOLDING PRESSURE)
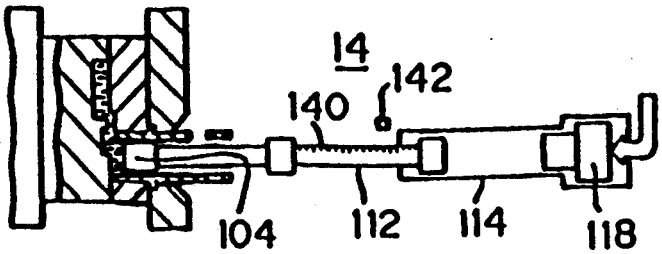

WORKING CHARACTERISTIC CHART OF THE DIE CASTING MACHINE DRAWN IN FIGURE 5

COUNTING DIE CAST MANUFACTURED GOODS

BACKGROUND OF THE INVENTION

1. Field of the Invention

This invention relates to the counting of goods manufactured by a die casting machine. More particularly, the invention relates to an arrangement (apparatus and method) for automatically counting die casting manufactured goods. The invention automatically distinguishes goods produced during a "waste shot" from those produced during normal operation of the die casting machine.

2. Description of the Related Art

Die casting machines are widely used for producing goods made of aluminum and other metals. Die casting machines are generally operated, in one of three modes: a "test shot" mode, a "waste shot" mode and a "normal" mode during which goods are produced. A "test shot" is an operating procedure carried out to determine the various conditions under which the die casting machine will be later operated during "normal" mode operation for continuously producing goods which satisfy production specifications.

The various conditions and parameters defining normal mode are determined by carrying out one or more test shots. For example, one condition that may need to be determined during one or more test shots might be the critical speed of a plunger during part of the injection molding process. For example, in the case of a two stage injection system, one or more test shots might be used to determine the critical speed of the plunger during a low speed injection process for filling a mold with molten metal. This is the speed required to avoid causing porosity in the die casting manufactured goods. Of course, this is only one example.

Other conditions may also be determined during test shots, such as, for example:

a) the speed of the plunger of injection during a low speed injection process;

b) the timing of a change of plunger speed from low speed to high speed; and c) the timing for increasing the pressure of molten metal (intensification) and the pressure thereof, and the like. Of course other conditions may also be determined during a test shot.

After operating in test mode for one or more test shots to determine various operating conditions, the die casting machine is operated in waste shot mode. One or more waste shots are carried out. Typically, waste shots are carried out at various times:

- during warming up of the die casting apparatus at initial start-up;
- during warming up of the apparatus after a pause in its operation; and
- when molten metal is loaded into a metal mold cavity to stabilize the temperature of the metal mold.

After carrying out one or more waste shots, the die casting apparatus is operated continuously for some time in its normal mode to manufacture die cast goods. During normal mode operation, the various operating parameters determined during test mode operation are used. Assuming that the various operating parameters were correctly determined during test shots, the goods produced should meet design specifications. The machine is operated in normal mode until the desired number of manufactured goods are produced. Thus, it is desirable to be able to count the individual goods produced.

It is known to provide a counter and a selecting switch for counting die cast manufactured goods. After a waste shot the selecting switch is manually turned on to actuate the counter. However, according to known practice, it is difficult to automatically count only the goods from normal shots because of the test shot and waste shot operations. The operator of a die casting machine must distinguish whether each piece of goods produced is from a normal shot, a test shot or a waste shot. The operator manually turns on and off the selecting switch to actuate the counter.

Accordingly, it is desirable to provide an arrangement for automatically counting manufacturing goods in a die casting machine that would eliminate the need for this type of operator involvement.

SUMMARY OF THE INVENTION

It is an object of the present invention to provide an apparatus for automatically counting die casting products.

The present invention achieves this object by providing an arrangement for automatically counting die casting manufactured goods.

According to the present invention there is provided a setting unit, by the use of which, the operator can preset data which defines normal shot operation of the die casting machine. There is also provided a detecting unit for detecting various conditions indicative of the operation status of the die casting machine and comparing those various conditions with the data previously set via the setting unit. A distinction unit distinguishes coincidence of the data detected by the detecting unit and the data previously set by the setting unit and outputs a coincidence signal indicative thereof. Each time there is a coincidence, a counting unit increases its count by one, thereby counting the number of the goods produced by the die casting machine.

Moreover, according to the present invention, there is also provided a method of counting die casting products. The method includes the following steps:

a) setting data for a normal shot operation of the die casting machine;

b) detecting operation if the detected data are substantially equal to the setting data then the distinction unit sends a coincidence signal status of the die casting machine;

c) distinguishing a coincidence of the operating status detected in a shot operation and the data set by the setting step; and d) counting the number of the die casting products in the case of existence of coincidence between the operation status and the data set by the setting step.

BRIEF DESCRIPTION OF THE DRAWINGS

FIGS. 5(*a*)–(*d*) show examples of relational parts of die casting machines and major operating modes to which the present invention is applied.

DETAILED DESCRIPTION OF THE PREFERRED EMBODIMENT

A preferred embodiment of the present invention will now be described in more detail with reference to the accompanying drawings.

Figure 2:
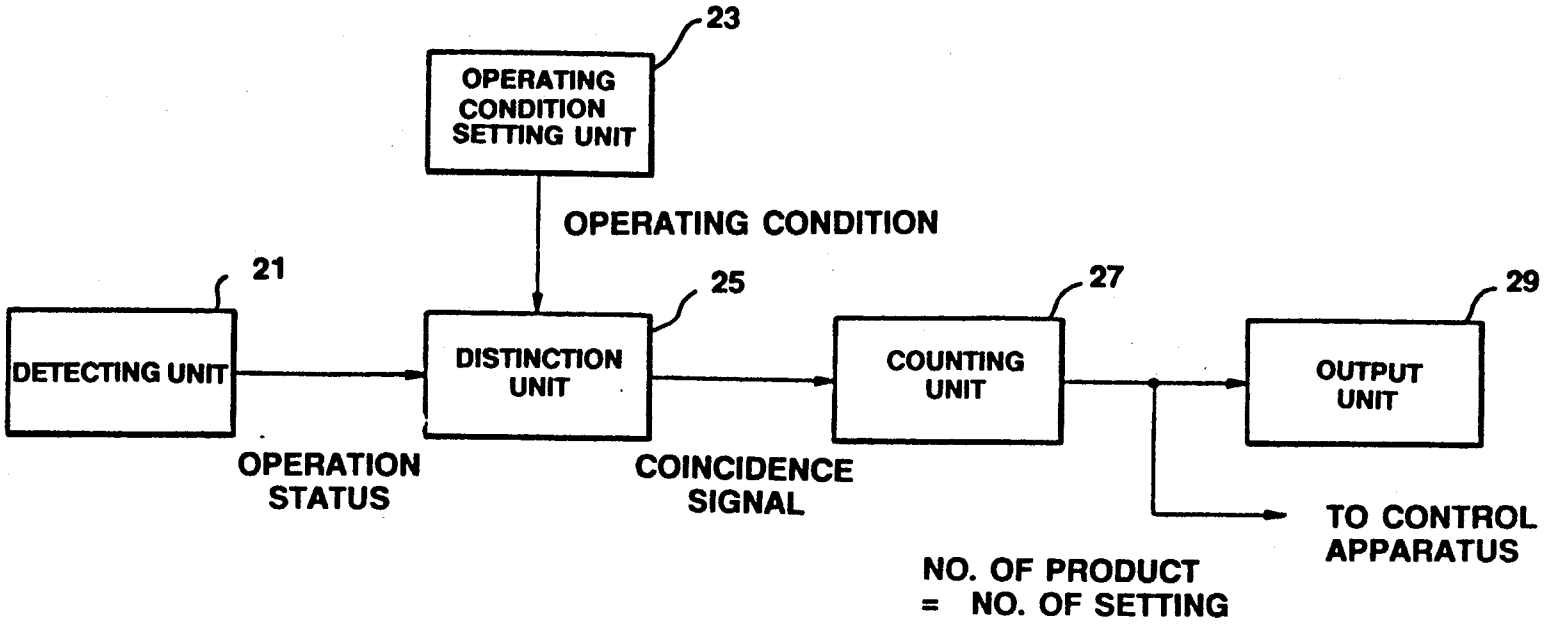
FIG. 2 is a block diagram of an apparatus, according to the present invention, for counting goods manufactured by a die casting machine.
Figure 3:
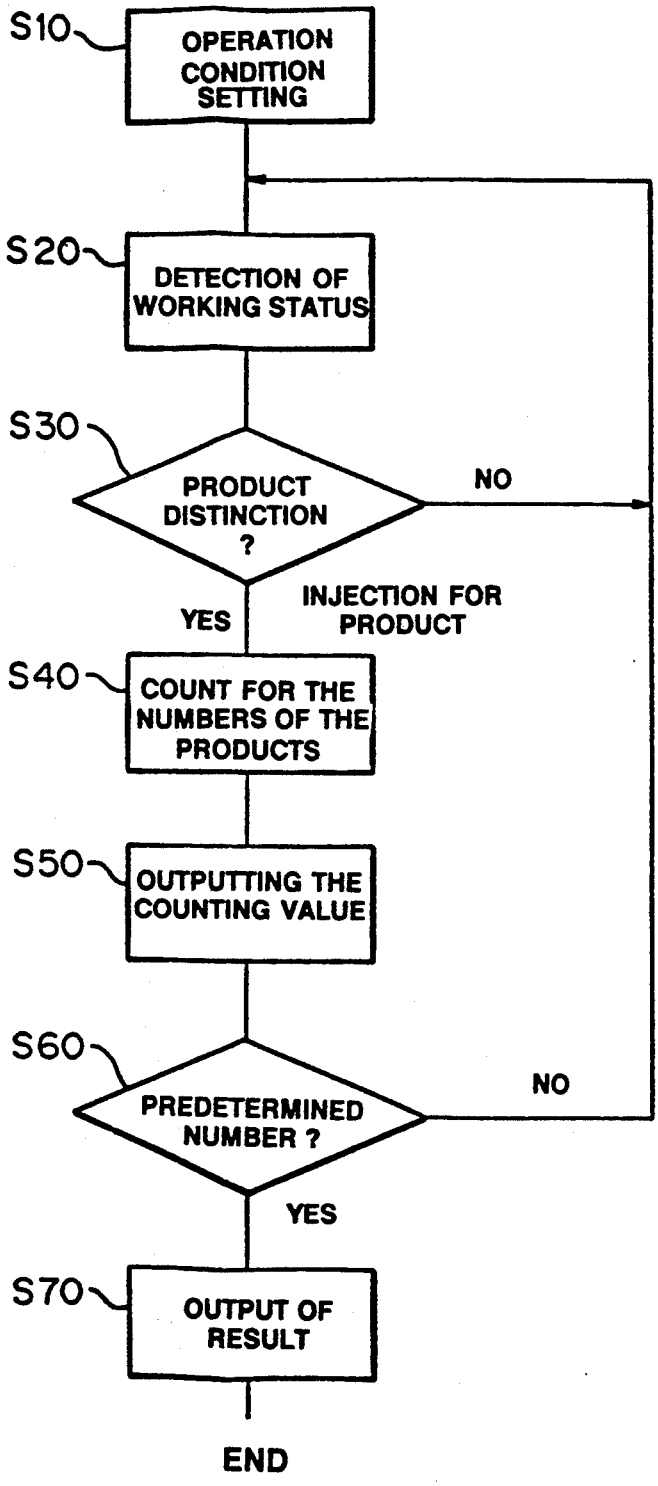
FIG. 3 is a more detailed flow chart explaining the method for counting die casting manufactured goods according to the present invention.

First, referring to FIG. 3, a presently preferred method, according to the present invention, for counting die casting machine manufactured goods will be described. The description that follows refers also to the apparatus shown in block diagram in FIG. 2.

Step S10

Figure 1:
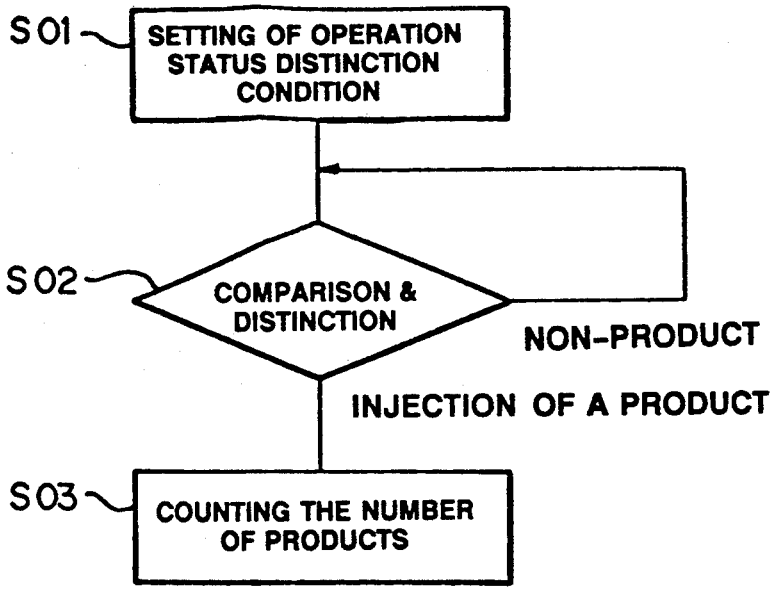
FIG. 1 is a flow chart setting forth the method of counting according to the present invention.

At step S10, data is input by the operator which specifies certain operating conditions. This step is the equivalent of step S01 in FIG. 1. In part, these conditions specify how the die casting machine should operate during a normal shot, i.e. during normal and continuous operations. These conditions can be used to distinguish normal shot operation from waste shot operation. Also, conditions are established for judging the operational status of the die casting machine. These conditions are decided depending upon the type of die casting machine being used and upon the type of goods to be manufactured. One or more test shots may be carried out to determine all of the appropriate conditions. The operator uses the setting unit 23 to set these conditions for normal use. These conditions are transferred to the distinction unit 25 which memorizes these operating conditions.

Step S20

Detecting unit 21 detects the operating status of the die casting machine and sends detection signals to distinction unit 25 during the operation (waste shot and normal operation) of the die casting machine.

Step S30

Distinction unit 25 receives signals from detecting unit 21 indicative of the operation of the die casting machine. Data corresponding to those signals are compared with data that have been previously stored in the setting unit 23. Distinction unit 25 determines whether or not there is appropriate correspondence between the data from detecting unit 21 and the data stored in setting unit 23. This step is equivalent to step S02 in FIG. 1. If the data appropriately correspond, distinction unit 25 generates a correspondence signal that is output to counting unit 27.

During a waste shot, operation running status is detected. Detecting unit 21 detects the status of the die casting machine and sends it to distinction unit 25. During a waste shot, there will not be an appropriate correspondence between the data from detecting unit 21 and the data stored in setting unit 23. Thus, a coincidence signal will not be output to counting unit 27.

However, during normal operation, there may or may not be appropriate coincidence, depending on whether the required operating conditions are being met. If the required operating conditions are not being met, distinction unit 25 may output an alarm signal which indicates an abnormal status of the die casting machine.

Step S40

Counting unit 27 increases its count by one when distinction unit 25 outputs a coincidence signal which corresponds to one injection operation for one normal manufactured good. This step is the equivalent of step S03 in FIG. 1.

The count registered by counting unit 27 may be cleared when operating conditions are input via setting unit 23. The count registered by counting unit 27 corresponds to the number of manufactured goods produced. When the count registered by counting unit 27 reaches a desired preset value, counting unit 27 outputs a signal which indicates that the number of manufactured goods have reached the desired value.

Step S50

The count registered by counting unit 27 may be displayed to the user in a variety of ways. For example, the count could be displayed via a cathode ray tube (CRT), or on some other type of display, such as a printer, light emitting diode, or other such output device. The count can either be continuously displayed or displayed when desired by the operator.

Step S60

Steps S20 through S50, described above, are repeated until the preset number of manufactured goods are produced.

Step S70

When the count registered by counting unit 27 coincides with the preset value in distinction unit 25, a signal is generated by counting unit 27 which indicates the end of production because the number of manufactured goods has reached the preset value.

When the counting arrangement is constructed such that it is separate and apart from the die casting machine, counting unit 27 may output a signal which indicates that production should be ended. This signal may be coupled to the die casting machine and utilized by the die casting machine to automatically stop its operation. Of course, the counting arrangement could be built into the die casting machine. A similar process of automatically stopping the operation of the die casting machine could be carried out internally.

Figure 4:
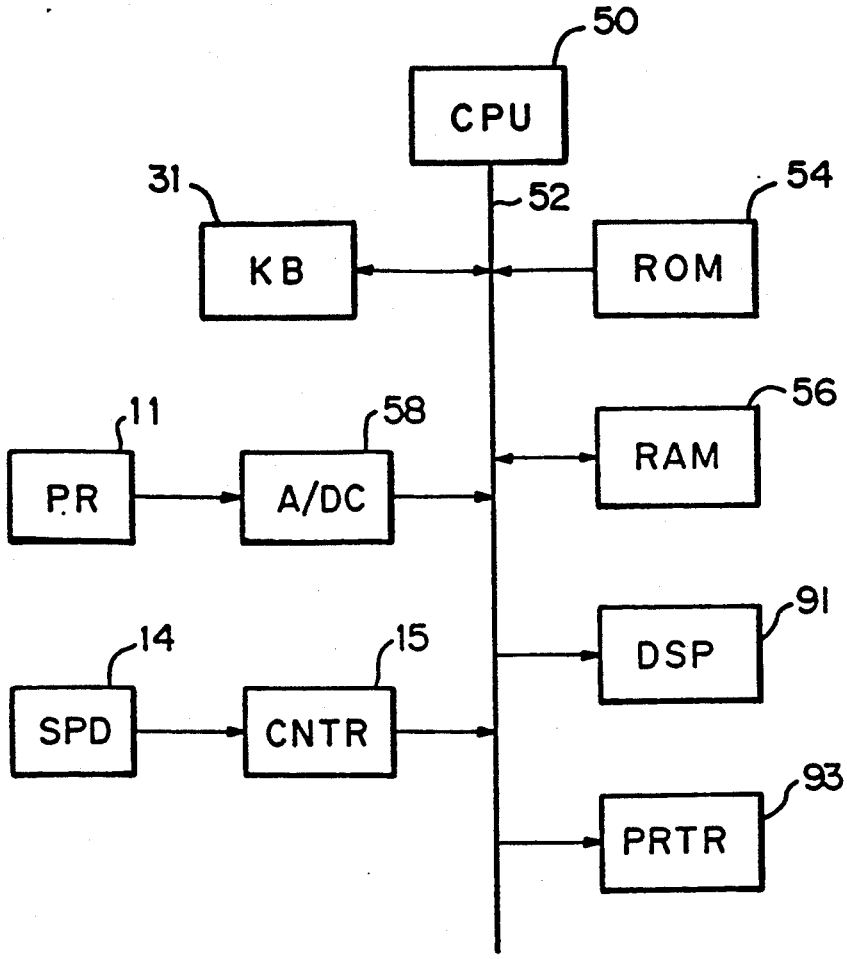
FIG. 4 illustrates a block diagram of an apparatus for counting die casting machine manufactured goods according to the present invention.

A presently preferred embodiment of the counting arrangement according to the present invention is shown in FIG. 4. In this embodiment, the counting arrangement is implemented using a microprocessor system. The embodiment includes a central processing unit (CPU) 50, a read-only memory (ROM) 54, a random access memory (RAM) 56, a display (labeled in FIG. 4 as "DSP") 91, a printer (labeled in FIG. 4 as "PRTR") 93 and a keyboard (KB) 31. The embodiment also includes pressure sensor (PR) 11, analog digital converter (A/DC) 58, speed detector (labeled in FIG. 4 as "SPD") 14 and counter (labeled "CNTR" in FIG. 4) 15.

The operation of this embodiment will be described with reference to FIG. 2. Detecting unit 21 of FIG. 2 is constituted by PR 11, speed detector 14 and counter 15. Operating condition setting unit 23 is constituted by KB 31. Distinction unit 25 is constituted by CPU 50, ROM 54 and RAM 56. Counting unit 27 is constituted by CPU 50 and RAM 56. Output unit 29 is constituted by display 91 and printer 93.

Converter 58 is connected to CPU 50 via a bus 52 in order to input signal information from PR 11. A speed value from counter 15 is input to CPU 50 via bus 52 and stored RAM 56. ROM 54 stores a control program for CPU 50. RAM 56 updates the count for each injection cycle (function of counter for manufactured goods) and temporarily stores data.

FIGS. 5(*a*) through (*d*) show the outline structure and the major operating parts of a die casting machine to which the present invention is applied. The die casting machine shown in this embodiment is of the horizontal type. However, the invention is equally applicable to other types of die casting machines.

The basic operating modes of the die casting machine include a pour process (charging process FIG. 5(*a*)), a low speed injection process (FIG. 5(*b*)), a high speed injection process (FIG. 5(*c*)), intensifying process (holding process FIG. 5(*d*)), a die opening process (not shown), an ejecting process (not shown), and piston 116 returning process and the like.

The following is a brief description of one injection cycle in the normal operation for manufacturing die cast goods.

As shown in FIG. 5(*a*), during a pouring process molten aluminum 201 in a holding furnace 100 is ladled out by a ladle 102 and poured into a sleeve 108 which is constructed between a plunger 104 and a cavity 106.

Figure 6:
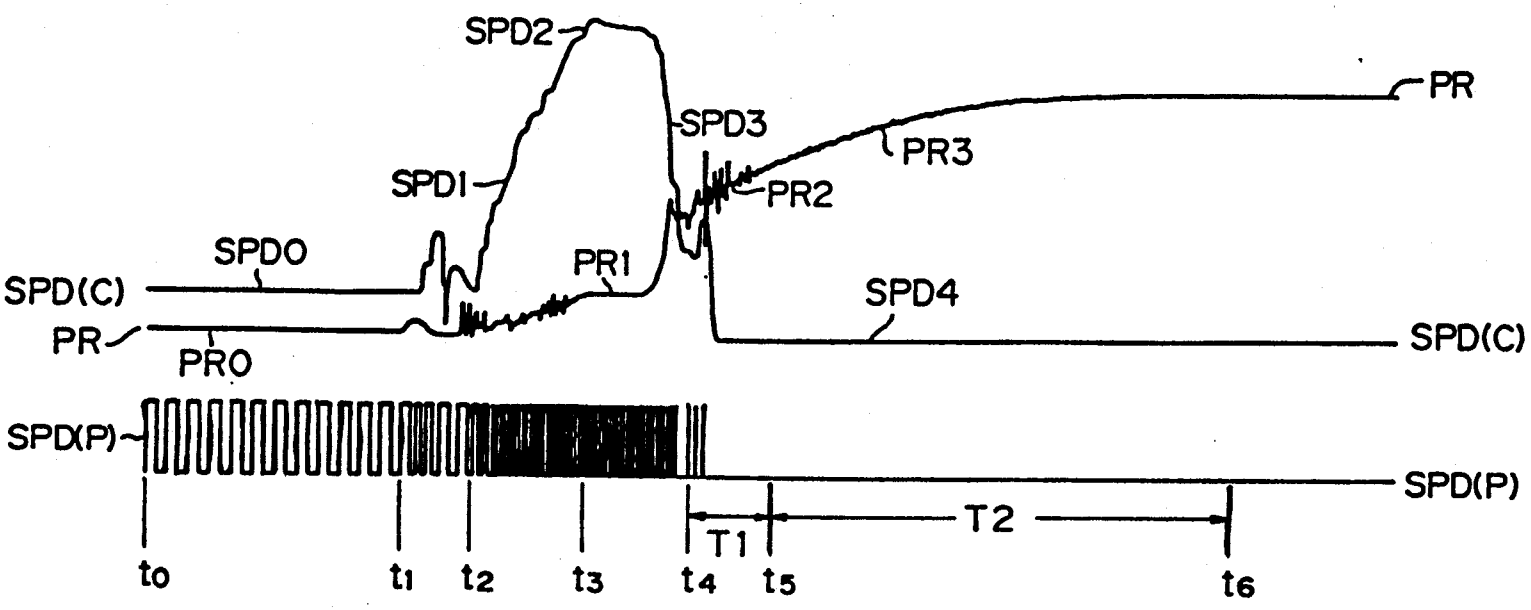
FIG. 6 illustrates the characteristic curves in the operation of the structures shown in FIGS. 5(*a*)–(*d*).

Then, as shown in FIG. 5(*b*), during the low speed injection process, the molten metal poured into sleeve 108 is injected by plunger 104 at low speed. A predetermined critical low speed is utilized in the low speed injection process to avoid porosity in the manufactured goods, resulting from absorption of air. Plunger 104 is driven by adding hydraulic pressure into injection cylinder 114 and injection piston rod 112 is pushed by the pressure. Then, plunger 104 is inserted into sleeve 108 via plunger rod 110 connected to injection piston rod 112. The low pressure process is operated from the time t0 to t2 as shown in FIG. 6. Injection piston rod 112 has magnetic scale 140 and non-magnetized trenches are provided with a fixed pitch in injection piston rod 112. Further, at the top part of injection cylinder 114, magnetic sensor 142 is set in order to detect the motion of magnetic scale 140; that is, the motion of injection piston rod 112. In this embodiment magnetic scale 140 and magnetic sensor 142 constitute speed detector 14 mentioned above (in this case, magnetic tape speed sensor). Magnetic scale 140 is set in the longitudinal direction of the piston rod 112. Thus, when magnetic scale 140 is moved with the motion of injection piston rod 112 by the hydraulic pressure, the motion is detected as the speed of injection speed. This is detected as speed pulses by the magnetic sensor SPD(P) as shown in FIG. 6. The speed is measured as pulse period. In other words, it corresponds to a pulse frequency. These pulses detected by magnetic sensor 142 are counted by counter 15. Counter 15 is updated in a predetermined period. Thus the number of pulses shows the speed of that period. The output of counter 15 is stored into RAM 56 via CPU 50. The counting speed of counter 15 is shown as SPD (c) in FIG. 6. Pressure sensor 11 is set in injection cylinder 114 in order to detect the pressure in the injection process. In this embodiment a strain gauge type of pressure sensor is used as pressure sensor 11 and the detected pressure value is shown as PR in FIG. 6. The detected pressure value is stored into RAM 56 via converter 58 and CPU 50.

This embodiment is based on a two stage type die casting machine. Thus the next process after the low speed injection process is the high speed injection process. In the high speed injection process beginning at t1, injection piston rod is moved rapidly and sleeve 108 is rapidly filled with the molten metal. Then cavity 106 is filled with the molten metal through the gate at the entrance. The characteristic of the high speed injection process is shown in FIG. 6 during the period of t2 through t4. As shown in FIG. 6 the speed SPD rises suddenly to a maximum at t3. Also the pressure PR rises slowly. When plunger 104 is pushed enough into sleeve 108, plunger 104 stops. As a result, the speed SPD goes nearly zero.

After the time t4, the intensifying process starts by adding high hydraulic pressure into a cylinder 118 having a large diameter. After the time T1 which is predetermined, for example, after T1=30 msec, the intensified pressure is held (holding pressure) during the time T2 from t5 to t6, for example t2=165 msec.

After the intensifying process a die opening process and ejection process thereafter are operated.

The waste shot operation is a warming-up operation so the high speed injection is not operated. The simplest way to distinguish a waste shot from normal shot is to test for the existence of the high speed injection process. For the first example of distinction, the process operation of the counting apparatus for the die casting manufactured goods is described.

EXAMPLE 1

The operator sets data as a condition to distinguish waste shots from normal shots. The data correspond to the level of SPD 1 in the high speed process of FIG. 6, which is recognized as high speed. Also, if it is requested that the number of manufactured goods is set, the number is sent at the same time to CPU 50 via KB 31. These data are stored in RAM 56. The distinction level SPD 1 may be any level which can distinguish high speed from low speed. CPU 50 clears the address in RAM 56 in correspondence with this setting operation. The address works as the counter (hereinafter referred to as "the manufactured good counter") for counting manufactured goods.

Under the conditions mentioned above, when waste shot is operated, pressure sensor 11 inputs a pressure signal via converter 58 and speed detector 14 inputs a signal indicative of plunger speed. Because this is a waste shot, the detected signal of the speed sensor does not exceed the predetermined distinction level and the control program stored in ROM 54 does not detect the high speed injection process. STEP S30 of FIG. 3 and the manufactured goods counter does not increase its count value. Accordingly, the number of manufactured goods is not increased during a waste shot operation.

After the waste shot operation, the operator sets data indicating the number of manufactured goods which are desired. If necessary, the distinction level SPD 1 of high speed injection may be corrected and the data for correction is set to CPU 50 via KB 31.

After the waste shot operation, the die casting machine is operated in a normal shot mode. During normal shot mode operation, CPU 50 detects that the speed signal changes from low speed to high speed and exceeds the distinction level (FIG. 3, STEP S30). Then the manufactured goods counter increases its count by one. The value of the manufactured goods counter is displayed on display 91 by CPU 50. (FIG. 3, STEP S50). When the value of the manufactured goods counter reaches the value originally set by the operator (FIG. 3, STEP S50), CPU 50 outputs the signal which shows the final shot for the manufactured goods. Then CPU 50 outputs the message to printer 93, which shows the final shot and the number of manufactured goods (FIG. 3, STEP S70).

EXAMPLE 2

In this example, the overall die casting process includes, during normal operation, an intensifying process. However, the intensifying process does not take place during waste shot operation. Thus, in this example, the decision of whether or not a waste shot is being carried out will be based on the existence of the intensifying process (rather than whether or not high speed injection is taking place, as in Example 1). In this case, pressure signal PR 2 shown in FIG. 6 is used in order to recognize whether an intensifying process is being carried out. When the speed of plunger 104 exceeds the level of high speed distinction and moreover the pressure of molten metal exceeds the level of PR 2, CPU, 50 recognizes that a normal shot is operated (FIG. 3, STEP S30). The other processes of CPU 50 are similar to those of Example 1.

EXAMPLE 3

In this example, the die casting process includes, in normal operation, a high speed injection and an intensification process. These processes are set by operation of a mode selection switch. Thus, in this example, signals from the mode switch are used to distinguish the type of process that is being carried out. In this example, a first "high speed on" switch signal is input and then an "intensification on" switch signal is input. Also, a normal mode selection signal is input. Furthermore, a detected speed signal and a detected pressure signal may be combined with these signals. (FIG. 3, STEP S30). To distingish one cycle from the next, a change of speed signal or pressure signal may be used.

EXAMPLE 4

In this fourth example, an increase in speed is used to distinguish a waste shot from a normal shot. Also, in this case one cycle of normal injection is recognized.

In this example, speed transition is utilized. The operator sets speed data SPD 0, SPD 1, SPD 3 and SPD 4. SPD 0 shows the speed of the low speed process and SPD 1 shows the speed for the start point of high speed injection. Also, SPD 3 shows the speed for the near end point of high speed injection and SPD 4 is the speed of holding pressure (near zero) KB 31 is used for setting these data and stores them to RAM 56 via CPU 50.

Under these conditions, CPU 50 increases the count of the counter by one when the speed signal is detected as the level of SPD 0 first, and then the level changes to SPD 1 through SPD 2, over SPD 2, less than SPD 3 and near to SPD 4, and also the pressure of molten metal goes over PR2 which shows the intensifying process. (FIG. 3, STEP S30 and STEP S40).

This results not only in the distinction of waste shot from normal shot, but also the recognition of the normal shot, that is, CPU 50 can recognize that the manufactured goods were not produced. Accordingly, if CPU 50 detects non-waste shot, CPU 50 can recognize the matching of the speed transition pattern mentioned above. In such a case, CPU 50 does not count the number as a normal shot. Then CPU 50 judges that the process was not operated normally and that the goods do not have the desired predetermined characteristics. Further, CPU 50 may output the alarm signal by the detection of this status.

EXAMPLE 5

As the fifth example, the pressure transition data are used to to distinguish the manufacture of normal products. In this example, both speed transition and pressure transition are used to recognize the behavior of the die casting machine. Data PR 0, PR 1, PR 2 and PR 3 are used and set in the RAM 56 via CPU 50 by KB 31. PR 0 is the data for recognition of the low speed injection process and PR 1 is the data for the high speed process. PR 2 is the data for recognition of the intensifying process and PR 3 is the data for the holding pressure process. (FIG. 3, STEP S10).

In this example, CPU 50 can distinguish waste shots from normal shots by means of detecting speed signals and pressure signals (FIG. 3, STEP S30) and can also recognize that die casting manufactured goods are produced in the normal operation.

EXAMPLE 6

This example utilizes time to distinguish operations of the die casting machine. Times T1 (the low speed injection time) and T2 (the high speed injection time) are set into RAM 56 by the operator. CPU 50 recognizes whether or not manufactured goods are produced in accordance with those times. When CPU 50 recognizes the shot which is not operated along these conditions, it decides that the process is not normal. In such case, CPU 50 does not cause the count of the counter to increase.

EXAMPLE 7

In this example, operation of the die casting machine is distinguished by the use of the working characteristic curve. The working characteristic curve includes pressure data of molten metal and speed data as shown in FIG. 6. The data of the working characteristic curve is stored in RAM 56 from KB 31 via CPU 50. CPU 50 recognizes the normal operation along the data which is set as the condition of the normal operation.

In this case, the detected data change fast so that the filtered data are used. Also setting data is average data of the normal shots. CPU 50 can afford to recognize the data which is detected in the normal operation and also uses the filtering technique in order to discriminate the speed signal and the pressure signal from the instantaneous signal and noise signals.

Although the embodiment described above shows examples in which the present invention is applied to a cold chamber die casting machine of a two stage injection system, it should be understood that the present invention is also applicable to die casting machines of different types, for example, a hot chamber die casting machine which is used for Zn alloy.

Furthermore, although the embodiment is described for the structure shown in FIG. 4, the present invention is not limited to this structure. Different structures may be used. For example, a manufactured goods counter which is independent from CPU 50 could be used and the initial status of the manufactured counter is cleared and set the number of product by CPU 50. When CPU 50 recognizes the normal shot operation in each shot, the counter is increased by one. At the time when the value of the counter reaches the preset value, the counter generates a signal which indicates the end of production.

The counting arrangement (both apparatus and method) can be built into a die casting machine or utilized in a separate and distinct physical structure. The invention is not limited to one or the other. For example, the counting arrangement could be built directly into the main control arrangement for a die casting machine.

As described above, according to the present invention, normal shot operation is distinguished from the waste shot. Also an abnormal shot is detected during otherwise "normal" operation of the die casting machine. According to the present invention, operation of the die casting machine is measured against predetermined conditions that are desired to be met during normal production. Accordingly, the exact counting of the products of the normal production of a die casting machine can be accomplished.

In summary, this invention provides a method and apparatus for automatic and exact counting of the die casting machine.

What is claimed is:

1. An apparatus for counting die casting products manufactured by a die casting machine, comprising:

setting means for inputting shot data indicative of accepting shot operation of the die casting machine;

detecting means for detecting an operation status of the die casting machine and generating operation status data indicative thereof;

distinction means for comparing the detection data with the input shot data and generating a coincidence signal upon a favorable comparison; and counting means, responsive to the coincidence signal, for counting the number of products produced by the die casting machine.

2. An apparatus according to claim 1, wherein the distinction means includes means for outputting the coincidence signal when an intensifying process is being carried out by the die casting machine.

3. An apparatus according to claim 1, wherein the distinction means comprises means for outputting the coincidence signal when a high speed injection process is being carried out by the die casting machine.

4. An apparatus according to claim 1, wherein the detecting means includes a pressure detector for detecting molten metal pressure.

5. An apparatus according to claim 4, wherein the pressure detector is a strain gauge.

6. An apparatus according to claim 1, wherein the detecting means includes speed detecting means for detecting speed of molten metal.

7. An apparatus according to claim 6, wherein the speed detecting means includes:

an injection cylinder for injecting the molten metal;

a magnetic scale marked on the rod of the injection cylinder; and a magnetic sensor for detecting magnetic data of the magnetic scale.

8. An apparatus according to claim 6, further comprising an output means for outputting data indicative of the number of the die cast products produced and the status of operation of the die casting machine.

9. An apparatus according to claim 8, wherein the output means includes a CRT display.

10. A method of counting die casting products manufactured by a die casting machine, comprising the steps of:

inputting shot data indicative of acceptable shot operation of the die casting machine;

detecting an operation status of the die casting machine;

distinguishing a coincidence of the detected operating status and the input shot data; and counting the number of times there is coincidence, the count indicating the number of die cast products produced.

11. A method according to claim 10, wherein the detecting step includes the step of detecting injection speed of a molten metal injected by the die casting machine.

12. A method according to claim 10, wherein the detecting step includes the step of detecting pressure of molten metal injected by the die casting machine.

13. A method according to claim 10, wherein the detecting step includes the step of detecting a status of a mode switch of the die casting machine.

14. A method according to claim 10, wherein the distinguishing step includes the step of recognizing a speed change of the molten metal during the injection process.

15. A method according to claim 10, wherein the distinguishing step includes the step of recognition of a pressure change of the molten metal during the injection process.

16. A method according to claim 10, wherein the setting step includes the step of setting low speed injection time and high speed injection time of the injection process.

17. A method according to claim 10, wherein the distinguishing step includes the steps of recognizing of low speed injection time and high speed injection time.

* * * * *